US006938392B2

(12) United States Patent
Fouad et al.

(10) Patent No.: US 6,938,392 B2
(45) Date of Patent: Sep. 6, 2005

(54) CONCRETE FILLED POLE

(75) Inventors: Fouad H. Fouad, Birmingham, AL (US); Wesley James Oliphant, Tomball, TX (US); C. Jerry Wong, West Palm Beach, FL (US)

(73) Assignee: Newmark International, Inc., Birmingham, AL (US)

( * ) Notice: Subject to any disclaimer, the term of this patent is extended or adjusted under 35 U.S.C. 154(b) by 0 days.

(21) Appl. No.: 10/444,299

(22) Filed: May 23, 2003

(65) Prior Publication Data

US 2005/0097855 A1 May 12, 2005

Related U.S. Application Data

(60) Provisional application No. 60/403,523, filed on Aug. 14, 2002.

(51) Int. Cl.[7] ..... E01F 9/01

(52) U.S. Cl. ..... 52/730.4; 52/223.4; 52/724.5; 52/736.3

(58) Field of Search ..... 52/730.4, 223.4, 52/724.5, 730.2, 736.3, 740.7, 721.4

(56) References Cited

U.S. PATENT DOCUMENTS

| | | | | |
|---|---|---|---|---|
| 408,379 A | | 8/1889 | Cunningham | |
| 909,299 A | | 1/1909 | Hilborn | |
| 973,670 A | | 10/1910 | Kinnear | |
| 1,087,334 A | | 2/1914 | Stevens | |
| 1,858,512 A | | 5/1932 | Langenberg et al. | |
| 3,354,657 A | | 11/1967 | Turzillo | |
| 3,958,381 A | | 5/1976 | Meyer | |
| 3,987,593 A | | 10/1976 | Svensson | |
| 4,018,055 A | | 4/1977 | Le Clercq | |
| 4,127,002 A | * | 11/1978 | DeWitt | 405/239 |
| 4,616,464 A | | 10/1986 | Schleich et al. | |
| 4,738,058 A | | 4/1988 | Svensson | |
| 4,783,940 A | | 11/1988 | Sato et al. | |
| 6,123,485 A | | 9/2000 | Mirmiran et al. | |
| 6,295,782 B1 | * | 10/2001 | Fyfe | 52/721.4 |
| 6,705,058 B1 | * | 3/2004 | Foust et al. | 52/720.1 |

FOREIGN PATENT DOCUMENTS

| | | |
|---|---|---|
| EP | 0033008 | 8/1981 |
| FR | 1 260 146 | 5/1961 |
| GB | 745 329 | 2/1956 |

* cited by examiner

*Primary Examiner*—Carl D. Friedman
*Assistant Examiner*—Basil Katcheves
(74) *Attorney, Agent, or Firm*—Camoriano and Associates; Theresa Fritz Camoriano; Guillermo E. Camoriano

(57) ABSTRACT

A concrete filled pole includes longitudinally aligned reinforcing rods secured to the casing along vertices of its polygonal cross-sectional shape so as to improve the flexural load carrying ability of the pole.

5 Claims, 1 Drawing Sheet

CONCRETE FILLED POLE

This application claims priority from provisional application Ser. No. 60/403,523, filed Aug. 14, 2002.

BACKGROUND OF THE INVENTION

The present invention relates to concrete poles, and, in particular, to a concrete filled metal pole with excellent flexural characteristics.

In the prior art, many concrete filled steel columns may be found, such as U.S. Pat. No. 4,783,940 "Sato" which is for a concrete filled steel tube column, and U.S. Pat. No. 4,018,055 "Le Clercq" which is for a concrete filled steel caisson. In some instances, such as in "Sato", the column is pre-stressed so that, when the column is subjected to axial loading, most if not all, of the loading is taken up by the concrete, which is excellent in compression, and very little of the load is transmitted to the steel casing. In these instances, the steel casing is used as a convenient way to hold the concrete during manufacture, and projections, if any, extending from the steel casing to the concrete are used either to reinforce the concrete (not the steel pole) or to be able to apply a pre-stress to the column such that, after loading, the concrete column preferentially takes up the load (instead of the steel casing).

A column is fixed at least at two locations, generally at the bottom (fixed to the ground by burying, bolting, etc.) and at the top where it is connected to other building structures such as ceilings, beams, etc. Resistance to axial loading is critical, but resistance to flexural loading is unimportant because there is little, if any, flex loading given that the column is fixed at least at two locations. The concrete is used because it is excellent in compression (axial loading), and the outside shell is used mostly (if not exclusively) to support the concrete. Radially extending projections (such as in Sato) are used to enhance the binding between the concrete and the shell so one can apply the post-tensioning loads.

A pole, on the other hand, is fixed at only one location (typically bolted or buried to the ground at one end), and at the other end, a weight (like from a light fixture or wires hanging from the pole) results in a cantilevered load which imposes horizontal loads (flexural loads) which must be addressed.

One possible solution is to increase the thickness of the steel pole, adding significant cost. But one soon reaches a thickness where the pole can no longer be formed. Furthermore, along streets and roadways, the Americans with Disabilities Act (ADA) requires a minimum of 24 inches between any sidewalk and the curb. Any pole installed along these streets must typically fit into this limited space (typically 24"), and this thus becomes the maximum dimension of the pole at the base, further limiting the thickness of the steel pole.

SUMMARY OF THE INVENTION

The present invention provides a concrete filled, formed steel pole with axially aligned reinforcing rods extending substantially along the length of the steel pole. The reinforcing rods are preferably continuously welded to the steel pole, and the rods are preferably located along the longitudinal "bends" of the formed steel pole. The steel pole is formed in two or more sections to permit access for continuous welding of the rods to the inside surface of the steel pole, and then these sections are themselves secured to each other (by welding or bolting, for instance) to form the steel pole. Concrete is poured into the steel pole and, as it sets and cures, it binds with the inside surface of the steel pole as well as with the reinforcing rods. The rods serve to transfer the load from the outer steel casing to the inner concrete core, plus they provide additional binding surface area between the concrete and the steel, and substantially strengthen the steel pole so that it may flex or bend without buckling or collapsing. The reinforcing rods are preferably made from a material which offers high compatibility with the weld rod used to secure the rods to the steel pole.

DESCRIPTION OF A PREFERRED EMBODIMENT

FIGS. 1–4 show an example of a concrete filled steel pole 10, intended to be used for carrying electric power, and made in accordance with the present invention. Of course, it is known that similar poles could be used for other purposes, such as to support lighting fixtures, communications antennas, signs, and other structures.

Figure 4:
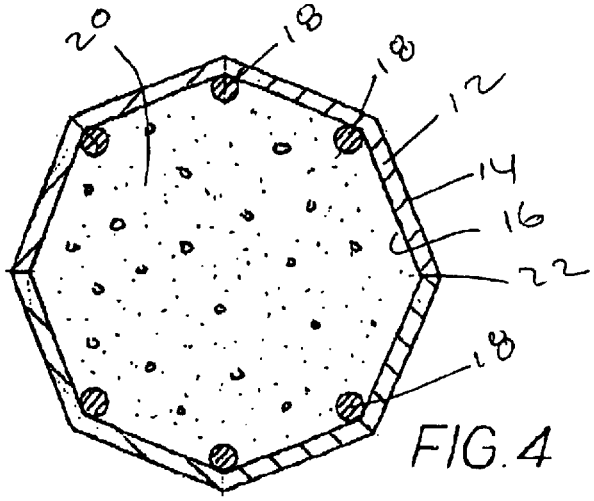
FIG. 4 is a view along line 4—4 of FIG. 1, showing a section through the assembled, filled pole.

Referring to FIG. 4, the pole 10 includes a steel outer casing 12 defining an outer surface 14 and an inner surface 16. In this embodiment 10, the casing 12 is a steel casing, but it is understood that it could be made from other materials, including iron, aluminum, copper, and others. The casing 12 is formed into a tapered, elongated, hollow pole with an octagonal cross-section, but it could be formed into other polygonal shapes, such as a hexagon or a nonagon. The pole has a large diameter at its base and a small diameter at its top end. The pole 10 also includes longitudinally-extending reinforcing rods 18 and an inner concrete core 20, as is explained in more detail below.

Figure 1:
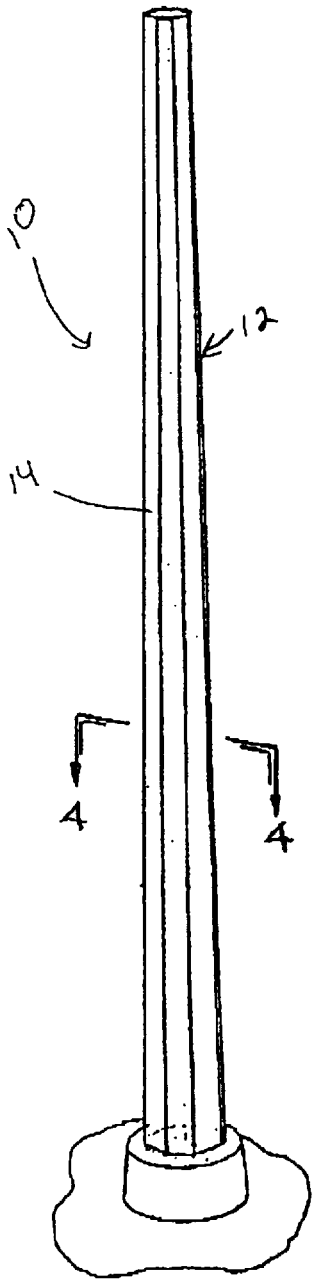
FIG. 1 shows an example of a concrete filled steel pole made in accordance with the present invention.
Figure 2:
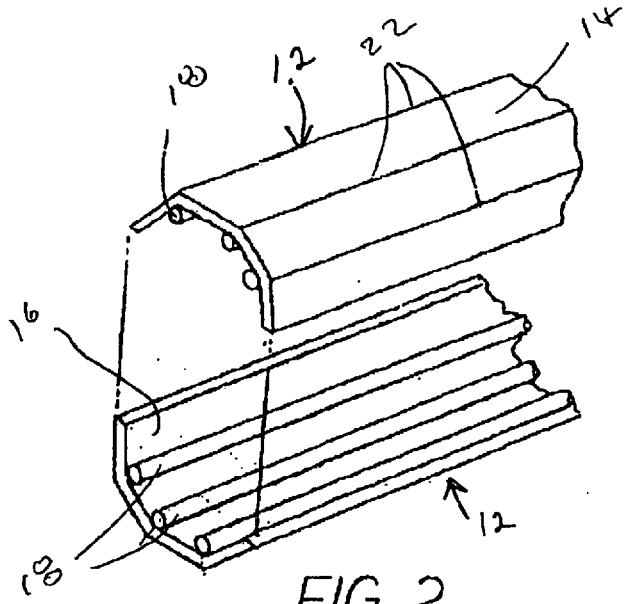
FIG. 2 is a broken away, exploded perspective view of the steel pool of FIG. 1 prior to filling it with concrete.

Referring now to FIG. 2, the steel casing 12 of this embodiment 10 is formed in two identical half-sections, with each section forming half of the octagonally-shaped cross-section. These sections have longitudinally extending creases or seams at the vertices 22 of the octagonal cross-section (where a flat plate has been bent or welded to form the octagonally-shaped cross-section) and, along the inside surface of these vertices 22, reinforcing rods 18 are secured to the casing, preferably by welding along the inside surface 16 of the steel casing 12. The rods 18 extend substantially along the entire length of the pole 10, and they are preferably made from a material which is compatible with the material of the weld rod used to secure the rods 18 to the casing 12. The rods 18 preferably are welded to the casing 12 along substantially their entire length, rather than being tack-welded or spot-welded at spaced-apart intervals.

Figure 3:
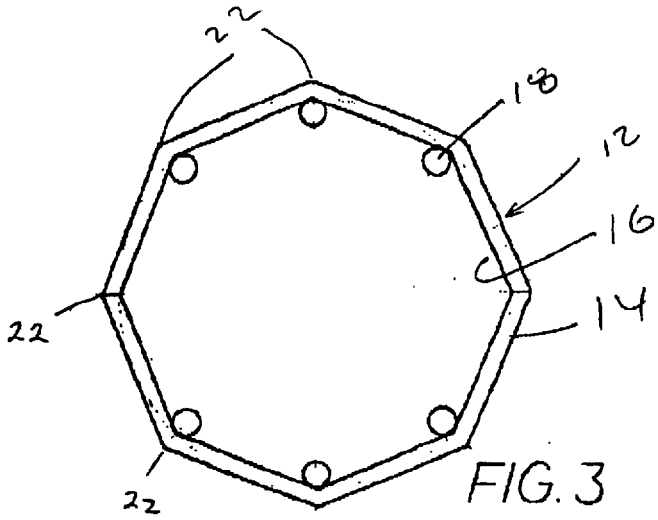
FIG. 3 is an end view of the steel pole of FIG. 2, once the pole is assembled and ready to be filled with concrete.

As shown in FIG. 3, once the rods 18 are secured to the half sections of the casing 12, the sections are brought together and secured, preferably by welding (though an alternate method, such as bolting, may be used), to make the one-piece steel casing 12 with the reinforcing rods 18. Finally, as seen in FIG. 4, the inner concrete core 20 is poured so as to fill the inside of the steel casing 12, such that the concrete 20 is in contact with the inside surface 16 of the steel casing 12, and is also in contact with the reinforcing rods 18.

The resulting concrete-filled steel pole 10 has a relatively thin steel casing 12, and the reinforcing rods 18 lend additional strength to the steel pole 10, especially for handling flexural loads, as well as aiding in transferring the load from the steel casing 12 to the concrete 20, and providing additional surface for binding the concrete 20 to the steel casing 12.

This particular embodiment has reinforcing rods along six of the eight vertices of the shell 12. It would be possible to weld reinforcing rods to the other two vertices prior to assembling the shell halves together in order to have reinforcing rods at all the vertices. It would also be possible to weld reinforcing rods along alternating vertices or in other arrangements as required by the loading to be put on the pole.

It will be obvious to those skilled in the art that modifications may be made to the embodiment described above without departing from the scope of the present invention.

What is claimed is:

1. A concrete filled pole, comprising:

an elongated metallic outer casing defining an inner surface and an outer surface and having a polygonal cross-sectional shape defining a plurality of vertices;

elongated metallic rods extending along the inner surface of at least some of said vertices, and secured to said inner surface of said outer casing along said vertices; and a concrete inner core, wherein said rods extend substantially along the length of the pole and said concrete inner core is in contact with said rods and with said inner surface of said casing.

2. A concrete filled pole as recited in claim 1, wherein said metallic outer casing is tapered from a larger diameter at the base to a smaller diameter at the top.

3. A concrete filled pole as recited in claim 1, wherein said rods are welded to said outer casing.

4. A concrete filled pole as recited in claim 1, wherein said polygonal shape is an octagon.

5. A method far making a concrete filled steel pole, comprising the steps of:

forming at least two metallic plates to define equally-spaced longitudinally extending vertices and to define an inner surface and an outer surface;

welding elongated rods along the inner surface of at least some of said vertices;

bringing said plates together and securing said plates together to form a shell having a polygonal cross-sectional shape; and pouring concrete into the interior of said polygonally-shaped shell such that said concrete is substantially in contact with said inside surface and in contact with said rods.

* * * * *